US008141564B2

(12) United States Patent
Cassese

(10) Patent No.: US 8,141,564 B2
(45) Date of Patent: Mar. 27, 2012

(54) ARTICLE FOR PRECISE APPLICATION OF MAKEUP

(76) Inventor: Michelle L. Cassese, Morristown, NJ (US)

( * ) Notice: Subject to any disclaimer, the term of this patent is extended or adjusted under 35 U.S.C. 154(b) by 475 days.

(21) Appl. No.: 12/012,700

(22) Filed: Feb. 5, 2008

(65) Prior Publication Data

US 2009/0194126 A1 Aug. 6, 2009

(51) Int. Cl.
*A45D 40/30* (2006.01)

(52) U.S. Cl. ..... 132/319; 132/320

(58) Field of Classification Search ..... 132/319, 132/320, 73.5, 76.2, 76.5, 285, 213, 214, 132/216, 217, 218, 287, 316, 317, 318; 101/127, 101/127.1; D28/7, 36, 73, 76, 9; 2/15, 11; 401/269, 54, 88, 98, 100
See application file for complete search history.

(56) References Cited

U.S. PATENT DOCUMENTS

| | | | | | |
|---|---|---|---|---|---|
| 1,873,928 | A | * | 8/1932 | Bohner | 132/216 |
| 1,907,476 | A | * | 5/1933 | Ballard et al. | 132/216 |
| D119,329 | S | | 3/1940 | Leyne | D28/36 |
| 2,467,570 | A | * | 4/1949 | Ward | 132/74.5 |
| 3,789,856 | A | | 2/1974 | Bomba | 132/319 |
| 4,033,364 | A | | 7/1977 | Inzana et al. | 133/216 |
| D252,890 | S | | 9/1979 | Cavalieri | D28/7 |
| D254,935 | S | | 6/1980 | Staudinger | D28/7 |
| D255,606 | S | | 6/1980 | Garcia | D28/9 |
| D257,400 | S | | 10/1980 | Cunningham | D28/7 |
| 5,016,658 | A | | 5/1991 | Green | 133/216 |
| 5,178,170 | A | | 1/1993 | Kassai | 132/319 |
| 5,311,888 | A | | 5/1994 | Leigh | 132/319 |
| 5,348,031 | A | * | 9/1994 | Cloud | 132/317 |
| 5,391,011 | A | * | 2/1995 | Gueret | 401/126 |
| 5,890,499 | A | | 4/1999 | Fuentes et al. | 132/319 |
| 5,909,740 | A | * | 6/1999 | Sussman | 132/318 |
| 5,957,142 | A | | 9/1999 | Karafilis | 132/319 |
| 5,960,802 | A | * | 10/1999 | Sakai | 132/320 |
| D423,714 | S | | 4/2000 | Fuentes et al. | D28/7 |
| 6,199,560 | B1 | | 3/2001 | North et al. | 132/319 |
| 6,305,389 | B1 | | 10/2001 | Bakken | 132/319 |
| 6,371,132 | B1 | * | 4/2002 | Lacout | 132/320 |
| 6,640,814 | B1 | | 11/2003 | Burke | 132/319 |
| 6,789,551 | B2 | | 9/2004 | Iosilevich | 132/217 |
| D532,929 | S | | 11/2006 | Weltmann | D28/7 |

(Continued)

FOREIGN PATENT DOCUMENTS

GB 2376882 12/2002

*Primary Examiner* — Todd Manahan
*Assistant Examiner* — Vanitha Elgart
(74) *Attorney, Agent, or Firm* — Ernest D. Buff; Ernest D. Buff & Assoc. LLC; Margaret A. LaCroix

(57) ABSTRACT

A lightweight, portable article for precise application of makeup is placed upon a user's eyelid skin, preferably the bottom eyelid skin, adjacent to the eyelashes. With this placement, a user can readily apply mascara and/or eyeliner without contacting the delicate eyelid skin. The article has a handle portion and an arcuate top portion. The arcuate top portion includes an applicator rim with rounded lateral edges and an arced central section, both of which are covered with the rubber guard. The rubber guard contiguously traverses the entire surface area of the applicator rim, resulting in a device yielding a high degree of safety. The article is formed of a smooth polymeric or metal material. It is compact, easily cleaned and enables application of mascara in a safe, hygienic manner.

14 Claims, 5 Drawing Sheets

U.S. PATENT DOCUMENTS

| | | | | |
|---|---|---|---|---|
| D536,129 | S | 1/2007 | Davis | D28/7 |
| 2002/0124865 | A1 | 9/2002 | Davis | 132/319 |
| 2004/0173234 | A1* | 9/2004 | Byun | 132/287 |
| 2004/0244812 | A1* | 12/2004 | Seidler et al. | 132/301 |
| 2005/0022838 | A1 | 2/2005 | Davis | 132/319 |
| 2006/0225761 | A1* | 10/2006 | Secosky | 132/218 |
| 2007/0080094 | A1* | 4/2007 | Moon | 206/581 |
| 2009/0183747 | A1* | 7/2009 | Salicunaj | 132/200 |

* cited by examiner

ARTICLE FOR PRECISE APPLICATION OF MAKEUP

BACKGROUND OF THE INVENTION

1. Field of the Invention

The present invention relates to an article for precise application of makeup; and more particularly to an article having an ergonomic handheld design, including an arcuate top portion containing a curved rim contoured in the shape of the eye and rounded lateral edges that are covered by a rubber guard, for interfacing the eyelid in a safe comfortable manner during application of makeup to an individual's lower eyelashes.

2. Description of the Prior Art

Application of makeup around the eye can be difficult. Steady hand movement is the order of the day, since close contact to the eye increases the risk of misapplication of makeup, or injury to the eye ball. When applying mascara, for example, even the slightest touch of the mascara wand against the skin proximal to the eyelashes results in mascara clumping or accumulating on the skin. Removal of unwanted mascara on the delicate skin contiguous to the eye can be difficult, and often results in the mascara streaking on the skin. Moreover, application of mascara can pose risks to the eye itself as the mascara wand moves in close proximity to the eye ball, potentially resulting in irritating or scratching one's eye if the wand unintentionally hits the eye ball. Even still, where steady application has been achieved, if the mascara wetted eyelashes, still not dry, close to contact the lower eyelid, mascara transfers to the loser eyelid skin and streak to skin of the lower lid.

Devices have been provided for curling and coloring lashes, generally being constructed having an upper and lower jaw, with mounting pads, that are hingedly connected and operate to apply concentrated pressure to progressively bend/curl and/or color a person's eyelashes. For example, see U.S. Pat. No. 6,789,551 to Iosilevich. These eyelash curling and coloring apparatuses cannot be readily utilized as a shield when applying make-up as the angle required to hold these bulky devices flush against the user's face would result in the jaws causing an obstacle. Rather these types of devices are constructed to be utilized to manipulate and color or contort the eyelashes rather than provide a shield during application of mascara.

Various make-up application shields have been provided in attempts to alleviate eye injury and make-up accumulation on the delicate skin surrounding the eye. However, the vast majority of these application shields fail to provide an application shield that is constructed having a rubber guard traversing rounded edges to enhance safety to the user's eye during use. For example, see U.S. Pat. No. 3,789,856 to Bomba, U.S. Pat. No. 5,178,170 to Kassai, U.S. Design Pat. No. D255606 to Garcia and U.S. Patent Application Publication No. 2005/0022838 to Davis. Sharp, un-rounded edges resultant from the construction of these application shields yield potential danger to the user as these edges can readily contact the user's eye ball and scratch, or worse puncture the eye ball. Moreover, these application shields do not provide a soft rubber guard or rim covering for comfortable, safe contact against the user's eyelid/under eye skin area.

Even where other heretofore disclosed and utilized application shields provide rounded edges, they fail to disclose an arcuate top portion having a rubber guard traversing the rounded edges and the arced central section. Examples of shield having rounded or slightly rounded edges can be found in the following, which generally provide devices with ergonomic handles arranged with a shield portion: U.S. Pat. No. 4,033,364 to Inzana et al.; U.S. Pat. No. 5,016,658 to Green; U.S. Pat. No. 5,311,888 to Leigh; U.S. Pat. No. 5,890,499 and Design Pat. No. D423714 to Fuentes, et al.; U.S. Design Pat. No. D119329 to Leyne; U.S. Design Pat. No. D252890 to Cavalieri; U.S. Design Pat. No. D254935 to Staudinger; U.S. Design Pat. No. D257400 to Cunningham; U.S. Design Pat. No. D532929 to Weltmann; and U.S. Patent Application Publication No. 2006/0225761 to Secosky. Although these types of application shields provide rounded or slightly rounded edges for enhanced safety of the eye and surrounding skin tissue, these shields fail to provide a rubber guard traversing the rounded edges. As such, these shields do not protect the user's eye from irritation, discomfort and scratching or other injury that can result from contact of the device with the eye ball or delicate skin. Various devices of this nature can also be found in the following examples, which involve shield portions with grooves for receiving eyelashes, including: U.S. Design Pat. No. D536129 and U.S. Patent Application Publication No. 2002/0124865 to Davis. There is no indication that these shield portions or curved edge and grooves are composed of rubber, and as such, discomfort during use and risk of injury to the delicate eye skin or eye itself are probable. Moreover, any application of these grooved eyelash makeup shields would require the user to align her eyelashes to be properly received within the corresponding grooves; otherwise the lashes could clump or stick together upon application of the mascara.

Other application shields teach a unitary body device that is virtually entirely composed of a silicone, foam, and/or polymeric material/flexible material. These unitary bodied devices provide a contiguous body of foam or flexible material, and do not provide a device composed of a hard, durable, impermeable plastic material constructed with a separate rubber guard rim. For example, refer to U.S. Pat. No. 6,305,389 to Bakken (a flange is provided, but same is integral with the guard, the piece being molded as one integral unit). Contiguous bodies of foam or flexible polymeric material shields may cause make-up, such as mascara, to accumulate on the guards, resulting in smudging onto the user's cheeks and face over time and introduce debris or bacteria into the eye of the user.

Still other devices are constructed providing a removable shield portion that is mounted on a handle portion and may be discarded after use to be replaced by a newly mounted shield, or is removed to reveal a fresh shield as part of a stack of shields (i.e. generally paper). For examples, refer to: U.S. Pat. No. 5,957,142 to Karafilis (applicator mask/shield formed of a generally soft, flexible material); U.S. Pat. No. 6,640,814 to Burke (mascara shield made of soft, flexible sheet material provided with adhesive band for mounting a release sheet); Foreign Publication No. GB2376882 to Mussett (shield composed of plastic or paper bearing an absorbent layer thereon); U.S. Pat. No. 6,199,560 to North, et al. (pad is formed of a plurality of leaves). Even though these shield portions are flexible in nature, they are not constructed having a non-porous shield body with an arcuate rim portion having rounded edges appointed with a rubber rim portion that traverses the rim of the shield body, separate from the shield body. Rather, these shields are constructed as unilateral bodies (or has a covering that covers the shield body) constructed of the flexible material. Inasmuch as the flexible material is porous, the shield body will be exposed to debris accumulation, requiring same to be discarded; but during its use accumulated debris would tend to cause clumping of the mascara and/or mascara debris which contacts the user's skin or is displaced into the user's eye.

Notwithstanding the efforts of prior art workers to construct makeup or mascara application devices, there remains a need in the art for an application device that (i) has a handle and an arcuate top portion formed of a smooth polymeric or metal material, which is easily cleaned, and (ii) is lightweight, compact and portable, thereby resulting in a hygienic eye applicator device. In addition, there exists a need in the art for an application device wherein the top portion has an arcuate shape, and includes an applicator rim with rounded lateral edges and an arced central section, both of which are covered with a rubber guard contiguously traversing substantially the entire surface area of the applicator rim to thereby enhance safety of the device during operation.

SUMMARY OF THE INVENTION

The present invention provides a lightweight, portable article for precise application of makeup. The article for precise application of makeup can be readily placed upon a user's eyelid skin, preferably the bottom eyelid skin, adjacent to the eyelashes so that a user can readily apply mascara and/or eyeliner without contacting the delicate eyelid skin. The article is constructed having a handle portion and an arcuate top portion that includes an applicator rim with a rubber guard. The article is formed of a smooth polymeric or metal material that is appointed to be easily cleaned and portable in nature resulting in a hygienic eye applicator device. The arcuate top portion includes an applicator rim with rounded lateral edges and an arced central section, both of which are covered with the rubber guard, so that the rubber guard contiguously traverses the entire surface area of the applicator rim resulting in a device yielding a high degree of safety.

The article for precise application of makeup includes a lower handle portion and an arcuate top portion. The arcuate top portion has an arcuate shape and an applicator rim. This arcuate shape enables the arcuate top portion to substantially embrace the user's cheek bone beneath the eyelid (as in the bottom eyelashes) to facilitate steady positioning and holding of the article when against the user's face. The applicator rim is constructed with rounded lateral edges and an arced central section contoured in the shape to the eye. The applicator rim is appointed with a rubber guard that traverses the rounded lateral edges and the arced central section of the applicator rim. This rubber guard is appointed to rest against lids beneath the eyelashes of a person's eye when applying makeup.

In an alternative embodiment, the article for precise application of makeup further includes an application cover provided to protect the article against scratching and soiling during non-use. This application cover is placed over the rubber guard. The application cover may include an outer surface appointed with a mirror integrated therein. In this embodiment, the application cover optionally further includes a flip cover that is hingedly attached to the outer surface of the application cover and closes over the mirror. Mating magnetic closures may be provide on the flip cover and outer surface of the application cover to provide secure closure of the flip cover over the mirror. Preferably, the article is constructed to be utilized with a user's lower eyelid when applying mascara to the user's lower eyelashes or when applying eyeliner.

The rubber guard comprises a first side and a second side, which may be arranged to form a concave rubber guard edge. In this embodiment, at least one of the first side or/and the second side of the rubber guard may be beveled having an angle of incline. Alternatively, the rubber guard comprises a first side and a second side arranged to form a convex rubber guard edge. In this embodiment, at least one of the first side or/and the second side of the rubber guard may be beveled having an angle of incline.

Optionally, the handle portion is hingedly connected to the arcuate top portion so that the handle portion can be rotated to abut the top portion for compact storage. The handle portion is preferably formed of a smooth polymeric material such same is easily cleaned. Alternatively, the handle portion may be composed of a metal material. Moreover, the handle portion may include a grip portion composed of a foam or rubber material for comfort and to prevent slippage within a user's hand. The arcuate top portion is preferably formed of a smooth polymeric material such that the top portion is easily cleaned. The rubber guard and arcuate top portion are preferably white in color. Both the handle portion and the arcuate top portion may be formed of a smooth polymeric material. Preferably, the handle portion and the arcuate top portion are formed of a polymeric material with antimicrobial or antibacterial products manufactured therein.

In another embodiment, the rubber guard may be removable from the applicator rim. This is achieved by providing that the rubber guard be appointed to snap onto the applicator rim so that the rubber guard can readily be replaced after a period of usage. In this manner, replacement rubber guards are provided.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE INVENTION

A lightweight, portable article for precise application of makeup is provided by the present invention. The article for precise application of makeup can be readily placed upon a user's eyelid skin, preferably the bottom eyelid skin, adjacent to the eyelashes so that a user can readily apply mascara and/or eyeliner without contacting the delicate eyelid skin. The article is constructed having a handle portion and an arcuate top portion that includes an applicator rim with a rubber guard. The article is formed of a smooth polymeric or metal material that is appointed to be easily cleaned and portable in nature resulting in a hygienic eye applicator device. The arcuate top portion includes an applicator rim with rounded lateral edges and an arced central section, both of which are covered with the rubber guard, so that the rubber guard contiguously traverses the entire surface area of the applicator rim resulting in a device yielding a high degree of safety.

Figure 1A:
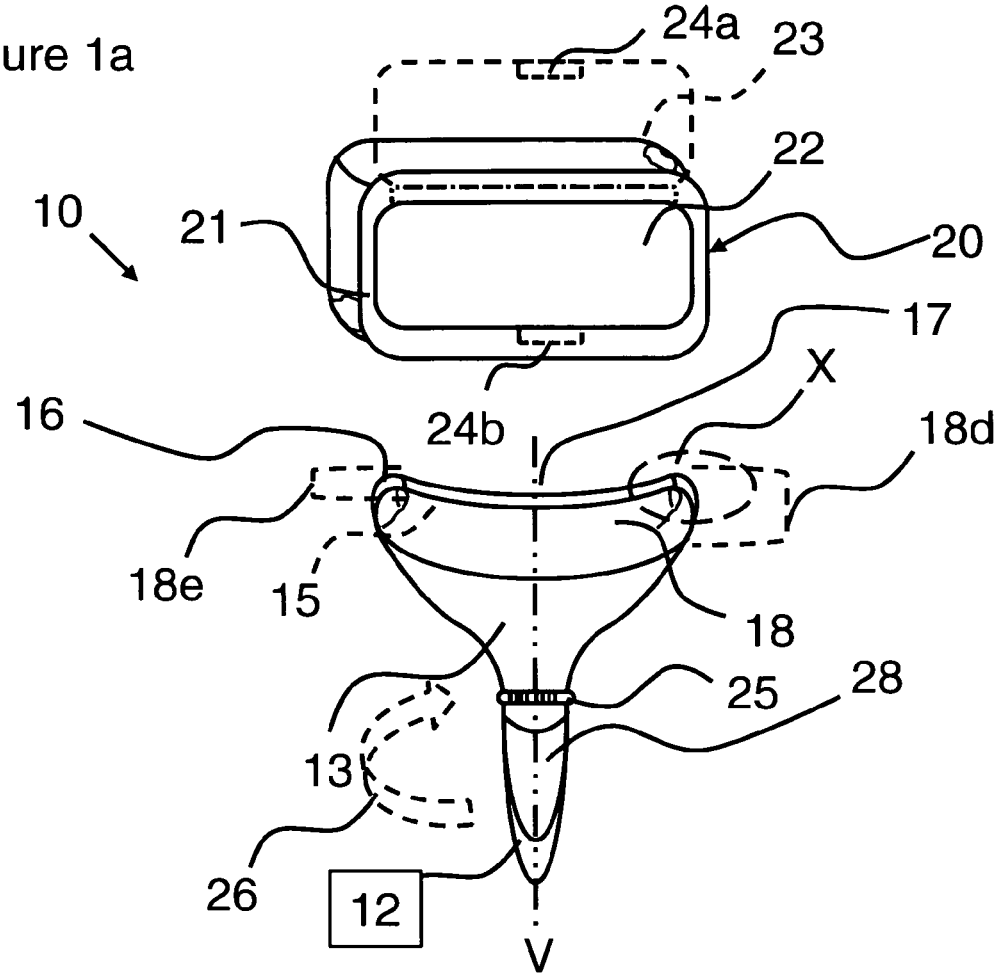
FIG. 1*a* illustrates a top view showing an embodiment of the article for precise application of makeup, wherein an embodiment of the optional cover is appointed to be placed on the article and the article is shown with the handle (lower portion) optionally pivotally attached and in the open configuration.

FIG. 1*a* illustrates a top view showing an embodiment of the article for precise application of makeup, wherein the optional cap is appointed to be placed on the article and the article is constructed with the handle (lower portion) being optionally pivotal on the device, shown generally at 10. Article for precise application of makeup 10 is constructed having a handle portion 12, arcuate top portion 13. Arcuate top portion 13 has an arcuate shape that is contoured to resemble that of a cheek bone directly under an eye so that the arcuate shape of the arcuate top portion 13 substantially embraces the user's cheek bone beneath the eyelid (as in the bottom eyelashes) to facilitate steady positioning and holding of the article when against the user's face.

Article 10 is formed of a smooth polymeric or metal material so that it is easily cleaned and does not accumulate makeup debris thereon. Preferably, article 10 is formed of smooth plastic, such as polytetrafluoroethylene (PTFE) commonly sold under the trade name TEFLON which is easily cleansed. Optionally, article 10 comprises a polymeric material with antimicrobial or antibacterial products manufactured therein. Preferably, rubber guard 18 and arcuate top portion is white in color so that the user can clearly see the eyelashes as the makeup is being applied. This white background provides optimal contrast for the user to see her eyelashes for precise application of makeup thereto. Preferably, rubber guard 18 comprises a polymeric material with antimicrobial or antibacterial products manufactured therein. The handle portion 12 may include a grip portion 28 composed of a foam or rubber material for comfort and to prevent slippage within a user's hand.

Arcuate top portion 13 includes an applicator rim 15 (shown via phantom call-out line to indicate same is under a rubber guard 18) constructed with rounded lateral edges 16 and an arced central section 17 contoured in the shape to the eye. Rounded lateral edges 16 and arced central section 17 are covered with a rubber guard 18 contiguously traversing substantially the entire surface area thereof. Rubber guard 18 has a depth 18*d* extending from applicator rim 15. Preferably this depth 18*d* of rubber guard 18 extends to traverse from applicator rim 15 onto an area of arcuate top portion 13 so that same is of a depth that resembles where eyelashes will rest when applicator 10 is being utilized. Rubber guard 18 has an edge 18*e*, configurations of which are shown in FIG. 3*a*-3*d*, taken along cut-out X. Rubber guard edge 18*e* may be slightly angled and/or have a rounded or curved edge, as discussed infra for FIG. 3*a*-3*d* and shown in respective the figures. Rubber guard 18 is appointed to rest against and interface with a person's eyelid beneath the eyelashes so that the local skin of the eye is effectively shielded from contact with mascara or eyeliner during application to the eyelashes or eyelash rims, respectively. Rounded lateral edges 16 (as opposed to sharp points and edges) act to protect the user against inadvertent damage to the eyes. Rubber guard 18 is placed at the article-eye interface to provide a soft contact between the article and user's delicate eye skin.

A cover/case 20 may be provided to protect article 10 against scratching and soiling during non-use. Such protection affords greater sanitation and protection to rubber guard 18 mitigating irritants from contacting rubber guard 18 and traveling into the eye during use of article 10, thereby decreasing the risk of infection, irritation, and injury to the eye. Optional cover 20 fits over the rubber guard 18 extending the depth 18*d* of same. Preferably, optional cover 20 fits over rubber guard 18 and over a portion of arcuate top portion 13. Optional cover 20 may include a mirror 22, such as on an outer surface 21 thereof for viewing application or touch-up of the mascara or eyeliner on the eyelashes. Alternatively, optional mirror 22 may be built into outer surface 21 of cover 20 and include a flip down cover 23 (shown in the open configuration in phantom) hingedly connected thereto, which may include mating magnetic engaging portion 24*a*, 24*b* located within flip down cover 23 and outer surface 21 of cover 20 for protection thereof. The article for precise application of makeup is lightweight, and readily portable in a purse or clothing pocket. The article may be sold having a variety of dimensions to suit a variety of eye shapes and sizes. These dimensions can be classes for different ethnic groups and can further be sub classed to include small, medium, or large.

Figure 1B:
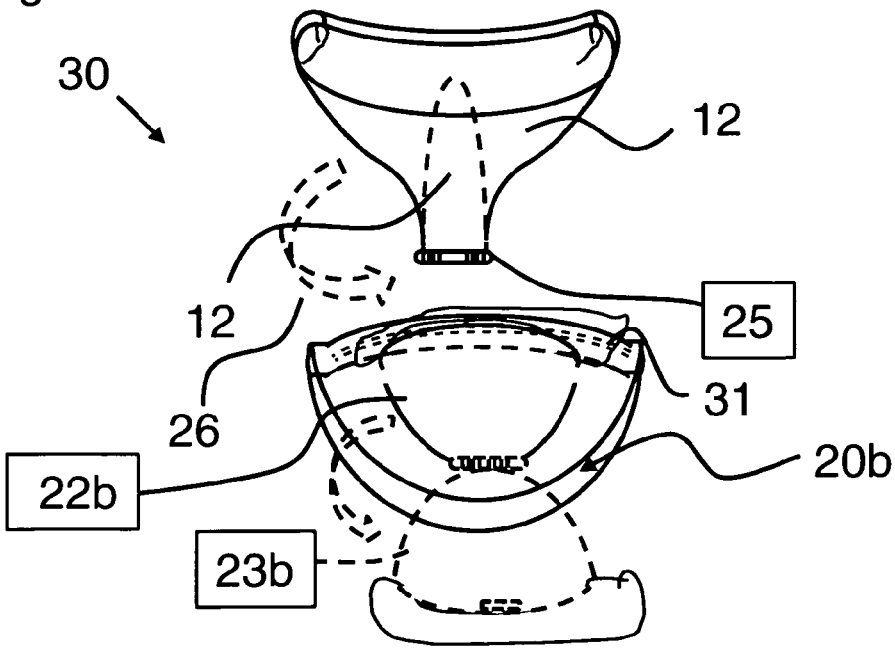
FIG. 1*b* illustrates a top view showing the embodiment of FIG. 1*a*, wherein the pivotally attached handle is in the closed configuration, and wherein an alternative embodiment of the optional cover is appointed to be placed over the folded article and encase same.

FIG. 1*b* illustrates a top view showing the embodiment of FIG. 1*a*, wherein the pivotally attached handle is in the closed configuration, and wherein an alternative embodiment of the optional cover is appointed to be placed over the folded article and encase same, shown generally at 30. Generally, handle portion 12 (i.e. the handle portion) is manufactured unified to arcuate top portion 13, as a unitary body. Alternatively, handle portion 12 may be pivotally connected by way of hinge 25 to arcuate top portion 13, so that handle portion 12 rotates approximately 180° inward (as indicated via phantom arrow 26) to lie planer and parallel to arcuate top portion 13 and semi-housed within arcuate top portion 13 for compact storage. Cover 20*b* may then be constructed to house the entire, including folded handle portion 12, article 10 as in the folded or compact condition. Article 10, and optional cover 20*b*, is inexpensive to produce and enables application of mascara or/and eyeliner to proceed in a safe, efficient manner. Cover 20*b* may include mirror 22*b* located on outer surface 21*b* thereof, and be appointed with a flip down cover 23*b* for protecting mirror 22 from damage. A zip closure 31 may be incorporated in cover 20*b* to encase folded article 10 for storage in a purse or makeup bag.

Figure 1C:
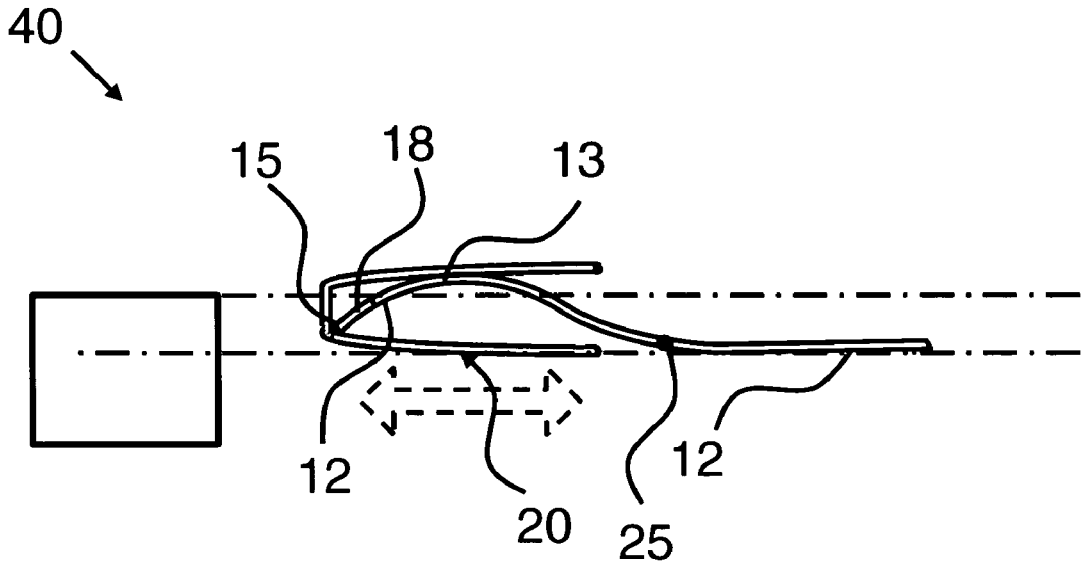
FIG. 1*c* illustrates a cross-sectional side view of the article for precise application of makeup taken along line V of FIG. 1*a;*

FIG. 1*c* illustrates a cross-sectional side view of the article for precise application of makeup taken along line V of FIG. 1*a*, shown generally at 40. The article for precise application of makeup 10 (FIG. 1*a*) is constructed having a handle portion 12 (which acts as a handle) and arcuate top portion 13. Arcuate top portion 13 has an arcuate shape that is contoured to resemble that of a cheek bone directly under an eye so that the arcuate shape of the arcuate top portion 13 substantially embraces the user's cheek bone beneath the eyelid (as in the bottom eyelashes) to facilitate steady positioning and holding of the article when against the user's face. Arcuate top portion 13 includes an applicator rim 15 having covered with a rubber guard 18 contiguously traversing substantially the entire surface area thereof appointed to rest against and interface with a person's eyelid beneath the eyelashes. Cover/case 20 is provided to protect the article against scratching and soiling during non-use. Herein, cover 10 is shown placed on the article, covering rubber guard 18. Such protection affords greater sanitation and protection to rubber guard 18 mitigating irritants from contacting rubber guard 18 and traveling into the eye during use of article 10, thereby decreasing the risk of infection, irritation, and injury to the eye. Handle portion 12 may be pivotally connected by way of hinge 25 to arcuate top portion 13 for compact storage.

Figure 2:
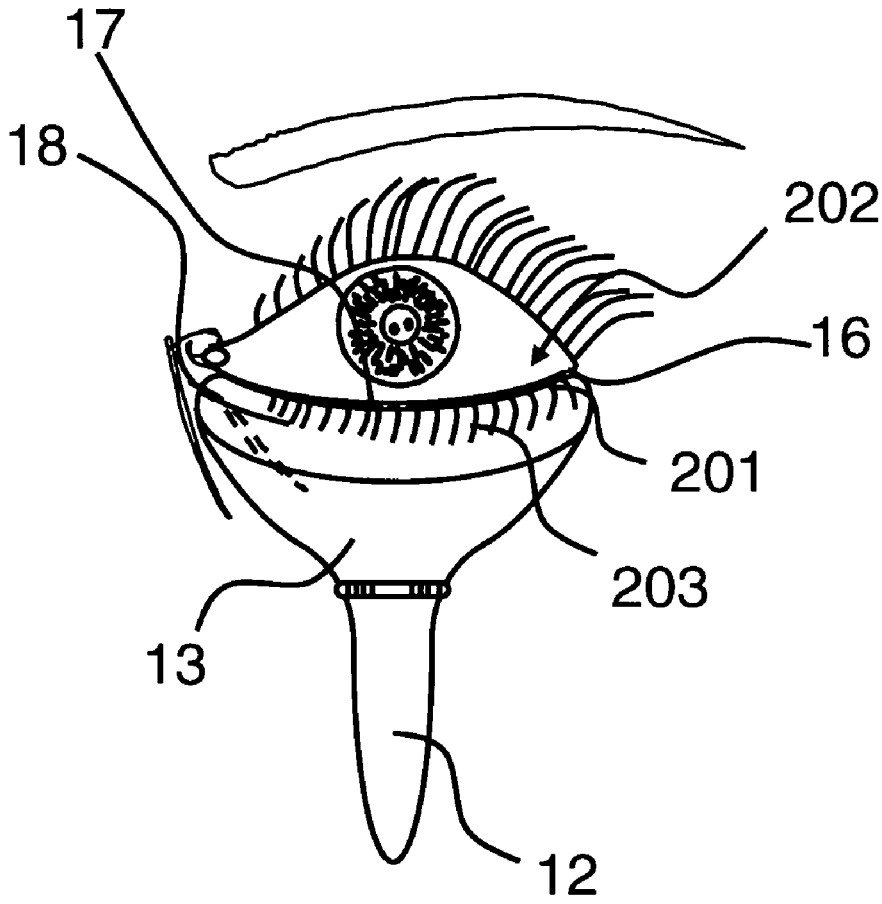
FIG. 2 illustrates a schematic view of the article for precise application of makeup being utilized on a user's lower eyelashes in applying makeup, such as mascara or eyeliner.

FIG. 2 illustrates a schematic view of the article for precise application of makeup shown in FIG. 1*a* being utilized on a user's lower eyelashes in applying makeup, such as mascara or eyeliner, shown generally at 200. Article for precise application of makeup 10 is constructed having a handle portion 12 which acts as a handle and an arcuate top portion 13 shaped in the curvature of a cheek bone under an eye. Arcuate top portion 13 includes an applicator rim having rounded lateral edges 16 and an arced central section 17 having the general shape of an eyelid 201 (particularly, the lower eyelid, as shown) of eye 202. Lower eyelid 201 includes eyelashes 203. Rim 15 is covered with a rubber guard 18 contiguously traversing substantially the entire surface area thereof. Preferably, rubber guard 18 has a depth extending from the applicator rim so that same is of a depth that resembles where eyelashes 203 will rest when applicator 10 is being utilized. Rubber guard 18 rests against and interfaces with eyelid 201 beneath eyelashes 203 so that the local skin of the eye is effectively shielded from contact with mascara or eyeliner during application to the eyelashes or eyelash rims, respectively. Rounded lateral edges 16 (as opposed to sharp points and edges) act to protect the user against inadvertent damage to eye 202.

Figure 3A:
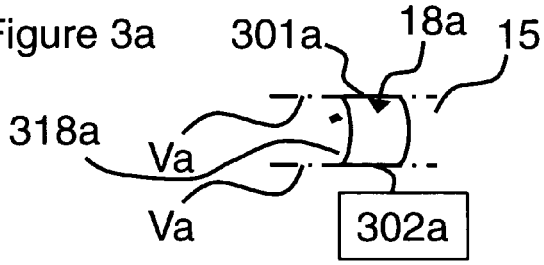
FIG. 3*a*-3*e* show cross-sectional views of the rubber guard taken along cut-out oval X of FIG. 1*a* showing the different configurations of the rubber guard.
Figure 3B:
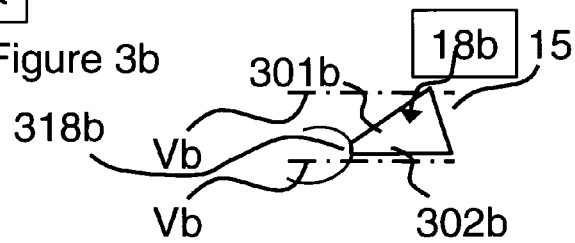
Figure 3C:
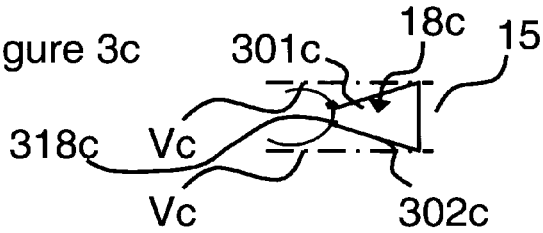
Figure 3D:
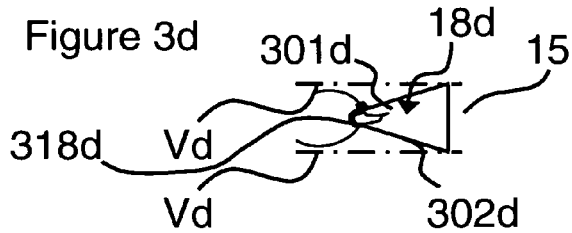
Figure 3E:
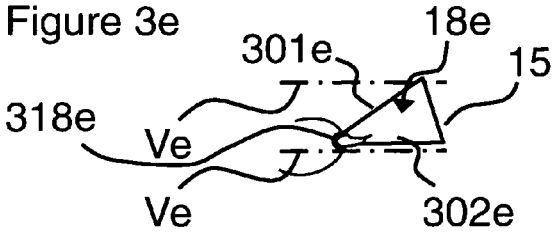

FIG. 3*a*-3*e* show cross-sectional views of the rubber guard, and visa vie applicator rim, taken along cut-out oval X of FIG. 1*a* showing the different configurations of the rubber guard. In each of the FIGS. 3*a*-3*d*, the applicator rim 15 is only partially shown, and rubber guard 18 is shown as 18*a*-18*d* and includes a first side 301*a*-301*d* (located on the topside of the device) and a second side 302*a*-302*d* (located on the underside of the device), respectively for each FIG. 3*a*-3*d*. For each of the FIGS. 3*a*-3*d* shield 18*a*-18*d* is shown extending from applicator rim 15, however, shield 18*a*-18*d* may instead be located on top of or as a coating on top of applicator rim 15). FIG. 3*a* shows rubber guard 18*a* with first side 301*a* and second side 302*a* being parallel arranged to form a rubber guard edge 318*a* that is concave in nature, appointed to abut a user's eyelid skin just under the eyelashes. FIG. 3*b* shows rubber guard 18*b* with first side 301*b* beveled or at an angle of incline, ranging from 20°-70°, most preferably being at 45° from line Vb, while second side 302*b* is parallel to line Vb arranged to form a rubber guard edge 318*b* that is concave in nature. In this manner, edge 318*b* rests against the user's eyelid and beveled first side 301*b* yields room for a brush of a mascara wand to traverse the length of the eyelashes. FIG. 3*c* shows rubber guard 18*c* with first side 301*c* and second side 302*c* both being beveled or at an angle of incline, ranging from 20°-70°, most preferably being at 45° from line Vc, arranged to form a rubber guard edge 318*c* that is concave in nature and beveled on both first and second sides, 301*c* and 302*c*. In this manner, edge 318*c* rests against the user's eyelid and beveled first and second sides 301*c* and 302*c* yield room for a brush of a mascara wand to traverse the length of the eyelashes. FIG. 3*d* shows rubber guard 18*d* with first side 301*d* and second side 302*d* both being beveled or at an angle of incline, ranging from 20°-70°, most preferably being at 45° from line Vd, and being appointed with a convex rubber guard edge 318*d*. In this manner, convex edge 318*d* rests against the user's eyelid so that convex edge 318*d* is placed directly under the eyelashes, resembling the curl of the eyelashes so that as the mascara wand travels over the eyelashes, convex rubber guard edge 318*d* not only protects the user's skin from mascara smudges, but further engages with the eyelashes to enhance curling of the lashes. FIG. 3*e* shows rubber guard 18*e* with first side 301*e* beveled or at an angle of incline, ranging from 20°-70°, most preferably being at 45° from line Ve, while second side 302*e* is parallel to line Ve arranged to form a convex rubber guard edge 318*e*. In this manner, convex edge 318*e* rests against the user's eyelid so that convex edge 318*e* is placed directly under the eyelashes, resembling the curl of the eyelashes so that as the mascara wand travels over the eyelashes, convex rubber guard edge 318*e* not only protects the user's skin from mascara smudges, but further engages with the eyelashes to enhance curling of the lashes.

Figure 4:
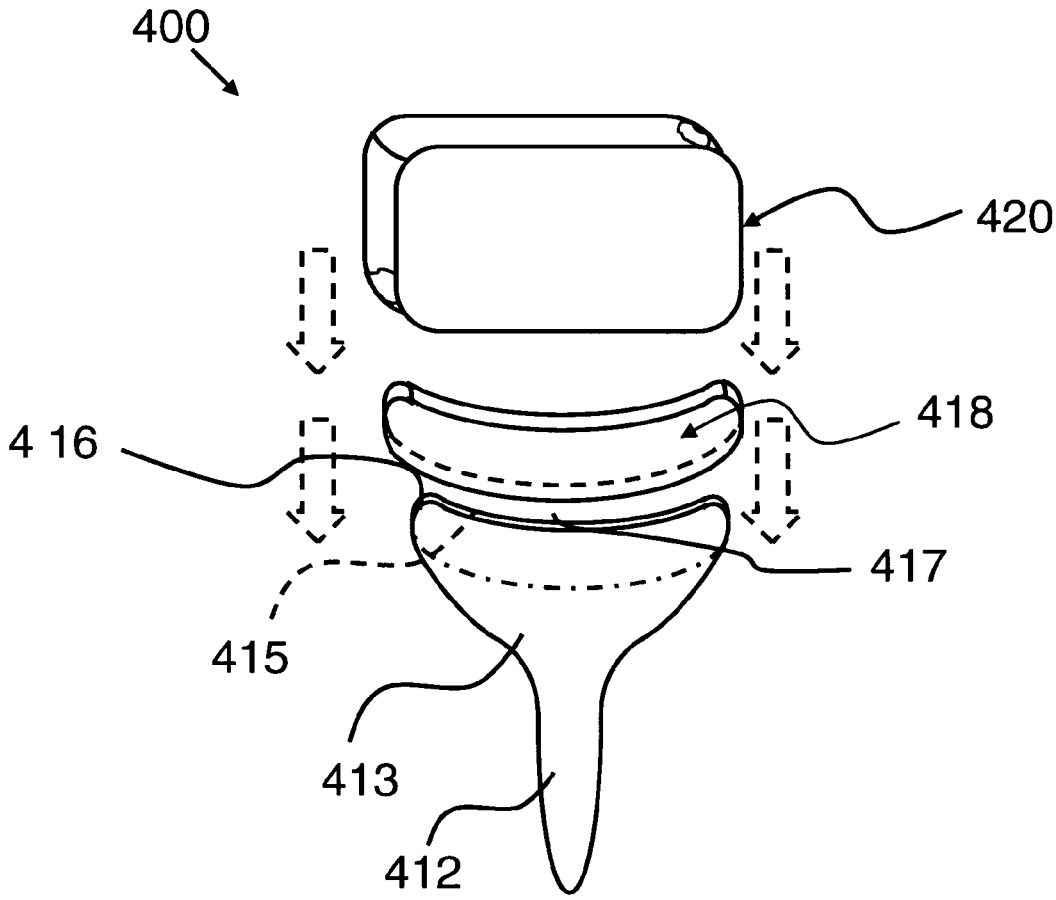
FIG. 4 illustrates a top view showing another embodiment of the article for precise application of makeup, wherein the rubber guard is removable for replacement and the optional cap is appointed to be placed on the article.

FIG. 4 illustrates a top view showing another embodiment of the article for precise application of makeup, wherein the rubber guard is removable for replacement and the optional cap is appointed to be placed on the article, shown generally at 400. Article for precise application of makeup 400 is constructed having a handle portion 412 (which acts as a handle), arcuate top portion 413. Article 400 is formed of a smooth polymeric or metal material so that same is easily cleaned and does not accumulate makeup debris thereon. Optionally, article 400 comprises a polymeric material with antimicrobial or antibacterial products manufactured therein. Arcuate top portion 413 includes an applicator rim 415 having rounded lateral edges 416 and an arced central section 417, appointed to be covered with a rubber guard 418 so that shield 418 contiguously traverses substantially the entire surface area of applicator rim 415. In this embodiment, rubber guard 418 is removable so that same can be replaced as needed. Rubber guard 418 slides over applicator rim 415 and snuggly fits there over. A cover/case 420 may be provided to protect article 400 against scratching and soiling during non-use. Such protection affords greater sanitation and protection to rubber guard 418 mitigating irritants from contacting rubber guard 418 and traveling into the eye during use of article 400, thereby decreasing the risk of infection, irritation, and injury to the eye. As such, rubber guard 418 snaps onto and is removable from applicator rim 415 so that rubber guard 418 can readily be replaced after a period of usage. Replacement rubber guards 418 are provided and may be sold separately. Preferably, rubber guard 418 is white in color.

The article has particular use in the application of mascara or eyeliner to the lower eyelashes or eyelid rim, respectively. The article provides an easy to use bottom lash precision tool. In operation, the user simply positions the tool under the bottom eyelashes and, working from the outer corner inward, brushes straight down with the mascara wand. Working in this manner facilitates in coating, and bringing out, even the most inner corner lashes. When the user is finished, the eyelashes are perfectly coated with no smudges to be removed and no mistakes to be corrected. The article can be utilized as a tool for applying eyeliner stencil before putting on mascara. The article can readily be cleaned with soap and water after each use.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An article for precise application of makeup, comprising:

a. a lower handle portion and an arcuate top portion;

b. said arcuate top portion having an arcuate shape and an applicator rim, said arcuate top portion being a solid body contiguous from said handle and said arcuate shape is contoured to be shaped as a cheek so that said arcuate top portion is adapted to substantially embrace a user's cheek bone to facilitate steady positioning and holding of said article when against said user's face;

c. said applicator rim being constructed with two symmetrical rounded lateral edges and an arced central section, said lower handle portion being centered in relation to said arced central section, said applicator rim having a rubber guard that has a corresponding arcuate shape and covers and contiguously traverses substantially the entire surface area of said rounded lateral edges and said arced central section of said applicator rim, wherein said rubber guard is appointed to rest against lids beneath eyelashes of said user's eye when applying makeup while said arcuate top portion rests against and embraces said cheek bone of said user;

d. said rubber guard snaps onto and is removable from said applicator rim so that said rubber guard can readily be replaced after a period of usage, and wherein replacement rubber guards are provided;

e. said rubber guard comprises a polymeric material with antimicrobial or antibacterial products manufactured therein;

f. said lower handle portion is formed of a smooth polymeric material with antimicrobial or antibacterial products manufactured therein, g. said arcuate top portion is formed of a smooth polymeric material with antimicrobial or antibacterial products manufactured therein, and h. said lower handle portion and said arcuate top portion are easily cleaned.

2. An article for precise application of makeup as recited by claim 1 comprising an application cover provided to protect said article against scratching and soiling during non-use, wherein said application cover is placed over said rubber guard.

3. An article for precise application of makeup as recited by claim 2, wherein said application cover includes an outer surface appointed with a mirror integrated therein.

4. An article for precise application of makeup as recited by claim 3, wherein said mirror integrated within said application cover has a flip cover that is hingedly attached to said outer surface of said application cover.

5. An article for precise application of makeup as recited by claim 4, wherein said flip cover include a magnetic closure that engages with a mating magnetic closure located within said outer surface of said application cover in close proximity to said mirror.

6. An article. for precise application of makeup as recited by claim 1, wherein said article is constructed to be utilized with a user's lower eyelid when applying eyeliner to said lower eyelid or when applying mascara to said user's lower eyelashes.

7. An article for precise application of makeup as recited by claim 1, wherein said rubber guard comprises a first side and a second side arranged to form a concave rubber guard edge.

8. An article for precise application of makeup as recited by claim 7, wherein at least one of said sides of said rubber guard is beveled having an angle of incline.

9. An article for precise application of makeup as recited by claim 1, wherein said rubber guard comprises a first side and a second side arranged to form a convex rubber guard edge.

10. An article for precise application of makeup as recited by claim 9, wherein at least one of said sides of said rubber guard is beveled having an angle of incline.

11. An article for precise application of makeup as recited by claim 1, wherein said handle portion is hingedly connected to said arcuate top portion so that said handle portion can be rotated to abut said top portion for compact storage.

12. An article for precise application of makeup as recited by claim 1, wherein said handle portion includes a grip portion composed of a foam or rubber material for comfort and to prevent slippage within a user's hand.

13. An article for precise application of makeup as recited by claim 1, wherein said rubber guard and arcuate top portion is white in color.

14. An article for precise application of makeup as recited by claim 1, wherein said handle portion and said arcuate top portion are formed of a smooth polymeric material.

* * * * *